US007341467B2

(12) United States Patent
Guan et al.

(10) Patent No.: US 7,341,467 B2
(45) Date of Patent: Mar. 11, 2008

(54) CARD EDGE CONNECTOR WITH EJECTING MEANS

(75) Inventors: Hai-Fei Guan, Kunshan (CN); Xue-Wu Bu, Kunshan (CN); Ting-Shun Liu, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/584,842

(22) Filed: Oct. 23, 2006

(65) Prior Publication Data

US 2007/0093097 A1 Apr. 26, 2007

(30) Foreign Application Priority Data

Oct. 21, 2005 (CN) ..... 2005 2 0076644 U

(51) Int. Cl.
*H01R 13/62* (2006.01)

(52) U.S. Cl. ..... 439/160; 439/157

(58) Field of Classification Search ..... 439/160, 439/157, 923

See application file for complete search history.

(56) References Cited

U.S. PATENT DOCUMENTS 5,090,916 A * 2/1992 Magnier ..... 439/352
5,211,568 A * 5/1993 Yamada et al. ..... 439/157
5,211,572 A * 5/1993 Comstock et al. ..... 439/352
5,443,394 A * 8/1995 Billman et al. ..... 439/157
5,445,531 A * 8/1995 Billman et al. ..... 439/160
5,511,985 A 4/1996 Noschese et al.
5,676,555 A * 10/1997 Yu et al. ..... 439/157
5,676,561 A * 10/1997 Chiang ..... 439/328
5,690,499 A * 11/1997 Howell et al. ..... 439/157
5,746,613 A * 5/1998 Cheng et al. ..... 439/157
6,113,404 A * 9/2000 Choy ..... 439/160
6,152,749 A * 11/2000 Tseng et al. ..... 439/160
6,296,511 B1 * 10/2001 Tseng et al. ..... 439/377
6,319,027 B1 * 11/2001 Pickles et al. ..... 439/157
6,824,407 B1 * 11/2004 Zhao et al. ..... 439/157
6,932,633 B2 * 8/2005 Tsai ..... 439/160
2004/0077198 A1 * 4/2004 Schlack ..... 439/160

* cited by examiner

*Primary Examiner*—Tulsidas C. Patel
*Assistant Examiner*—Vladimir Imas
(74) *Attorney, Agent, or Firm*—Wei Te Chung

(57) ABSTRACT

A card edge connector (100) for receiving a module comprises an insulative housing (2) having a pair of side walls (28) with a module-receiving slot (21) formed therebetween and a plurality of contact-receiving cavities (29) along the slot, and a pair of end walls (26) connected to the side walls; a plurality of contacts (3) retained in the corresponding cavities and having contacting portions (31) extending into the slot for engaging with the module; an ejector (5) pivotally mounted on the housing and having a gripping portion (530) which can be deformed toward the side wall along an insertion direction of the module, and a locking portion (529) for locking with the module; and a block (6) movably mounted on the housing and connected to the ejector to eject the module out of the slot in response to an outward rotation of the ejector.

20 Claims, 8 Drawing Sheets

CARD EDGE CONNECTOR WITH EJECTING MEANS

BACKGROUND OF THE INVENTION

1. Field of the Invention

The present invention generally relates to a card edge connector for receiving a module and more particularly to a card edge connector having an ejector for removing the module from the connector.

2. Description of Related Art

A conventional card edge connector fixed in an electronic device such as a computer, such connector disclosed in U.S. Pat. No. 5,511,985 is mounted on a printed circuit board (PCB) for receiving a memory module, comprises an elongated housing, a plurality of contacts received therein, and a pair of ejectors rotatably mounted on opposite ends of the housing and are widely used to lock/eject the module within/from the housing in a locking position and an unlocking position respectively. Generally, the connector with the memory module inserted therein and the PCB are adapted to be accommodated in a computer mainframe which comprising several pieces of metal plates. The metal plates typically include screws for latching with each other to define a box-shaped configuration. When the memory module inserted in the connector needs to be replaced, it is necessary to disassemble the metal plates by using screwdrivers to make the connector and the memory module exposed to an user firstly, and then to grip and rotate the ejector outwardly to lift the memory module out of the connector. With such arrangement, the disassembly of the computer mainframe makes it inconvenient to extract the module.

It is thus desired to provide an electrical connector to overcome the shortcomings described above.

SUMMARY OF THE INVENTION

An object of the present invention is to provide a card edge connector for facilitating extracting a corresponding module inserted therein.

Another object of the present invention is to provide a card edge connector formed with an ejector having a flexible gripping portion.

In order to achieve above-mentioned object, a card edge connector for receiving a module comprises an insulative housing having a pair of side walls with a module-receiving slot formed therebetween and a plurality of cavities along the slot, and a pair of end walls connected to the side walls; a plurality of contacts retained in the corresponding cavities and having contacting portions extending into the slot for engaging with the module; an ejector pivotally mounted on the housing and having a gripping portion which can be deformed toward the side wall along an insertion direction of the module, and a locking portion for locking with the module; and a block movably mounted on the housing and connected to the ejector to eject the module out of the slot in response to an outward rotation of the ejector.

Other objects, advantages and novel features of the present invention will become more apparent from the following detailed description of the present embodiment when taken in conjunction with the accompanying drawings.

DETAILED DESCRIPTION OF THE INVENTION

Figure 1:
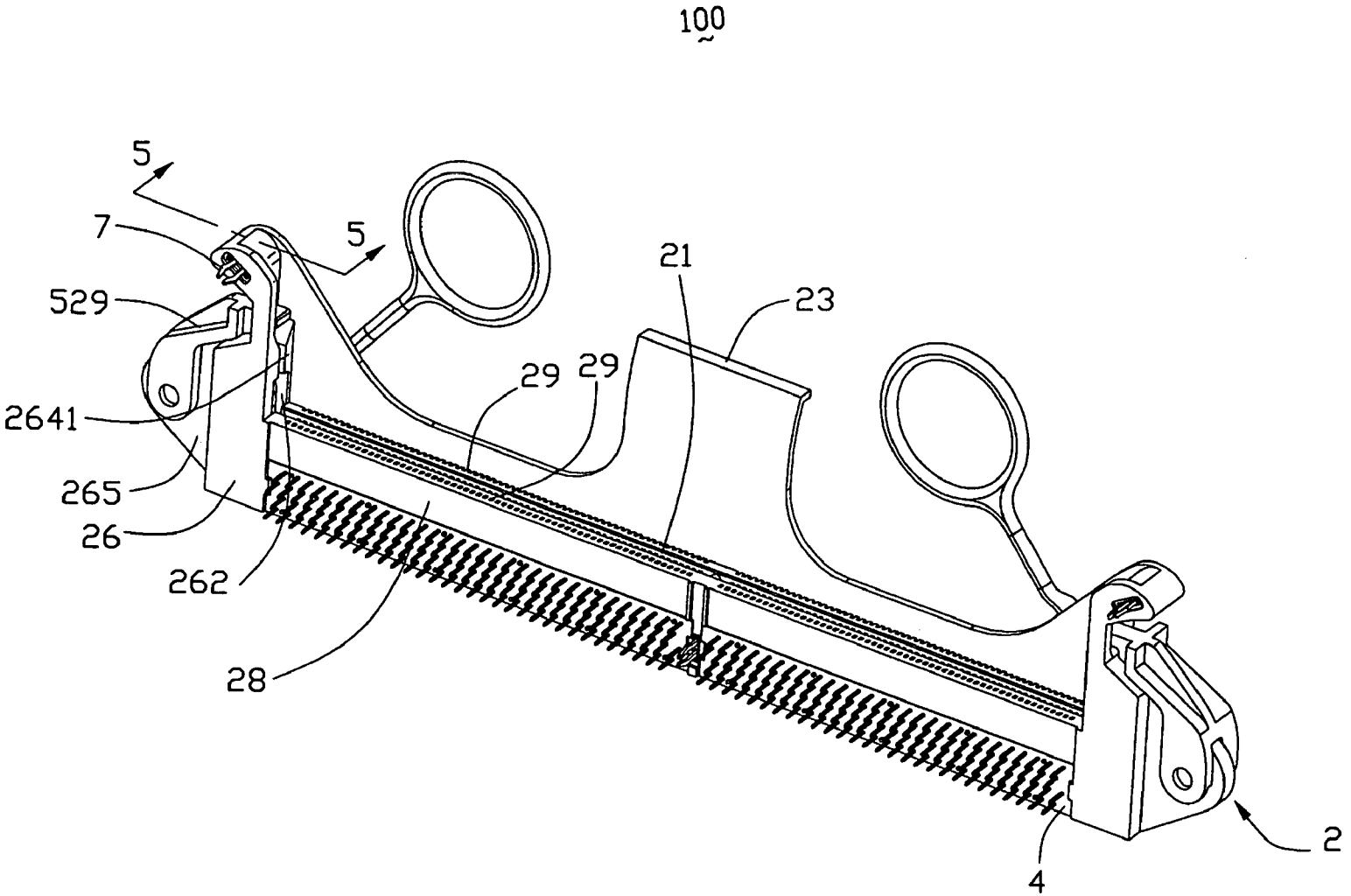
FIG. 1 is an assembled perspective view of a card edge connector in a locking position according to the present invention.
Figure 2:
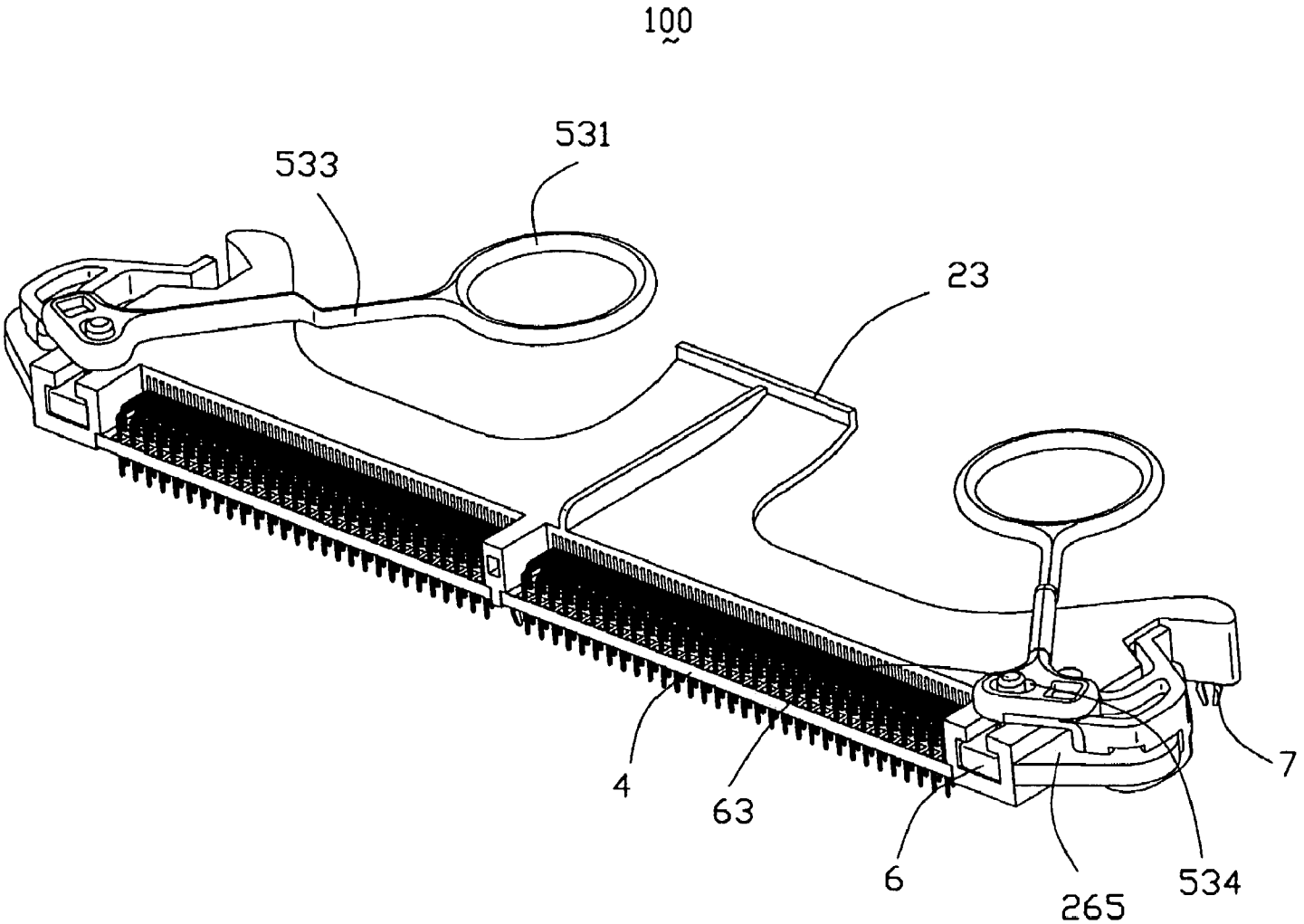
FIG. 2 is a view similar to FIG. 1, while taken from a different aspect.

Reference will now be made to the drawing figures to describe the preferred embodiment of the present invention in detail.

Figure 3:
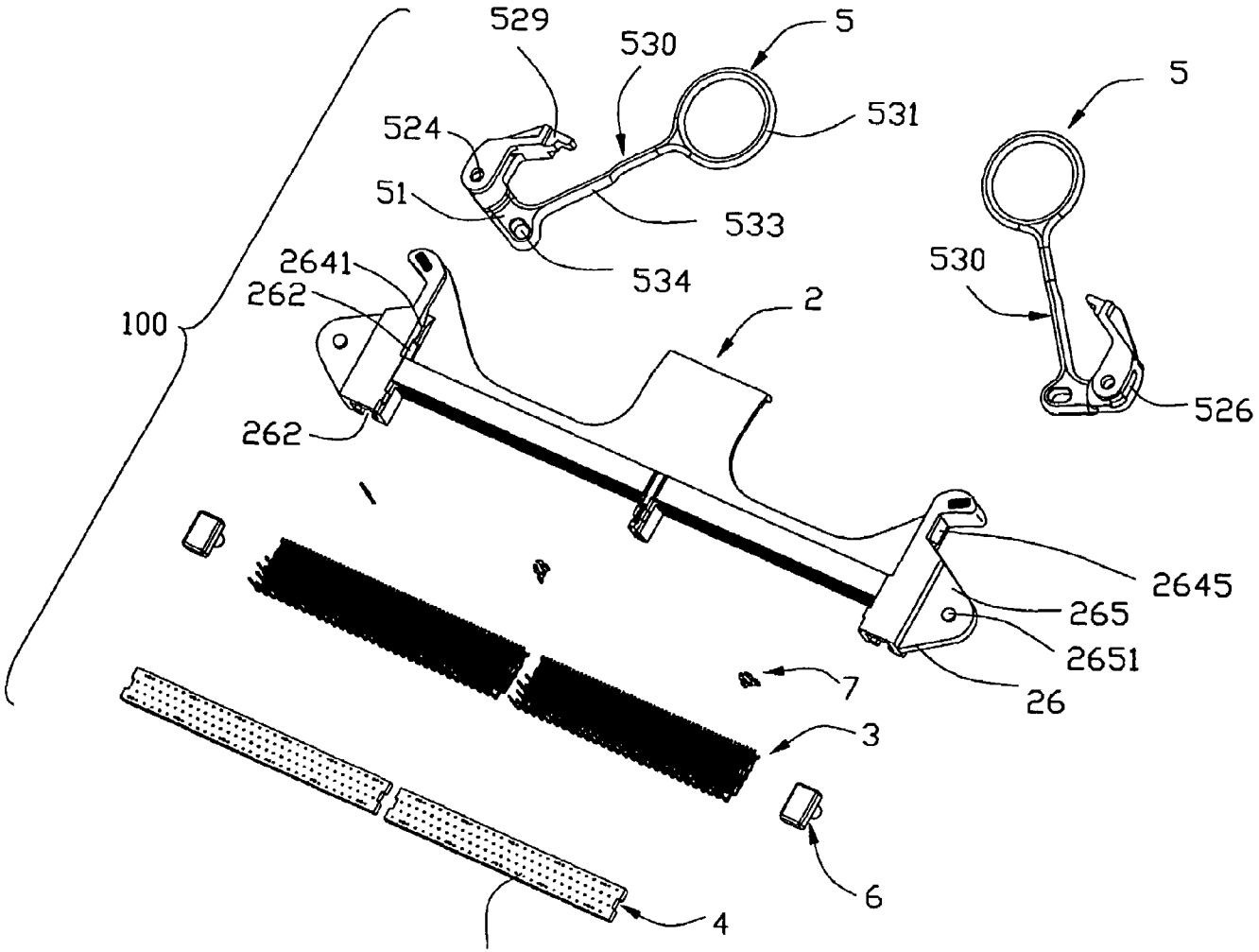
FIG. 3 is an exploded perspective view of the card edge connector of FIG. 1.
Figure 4:
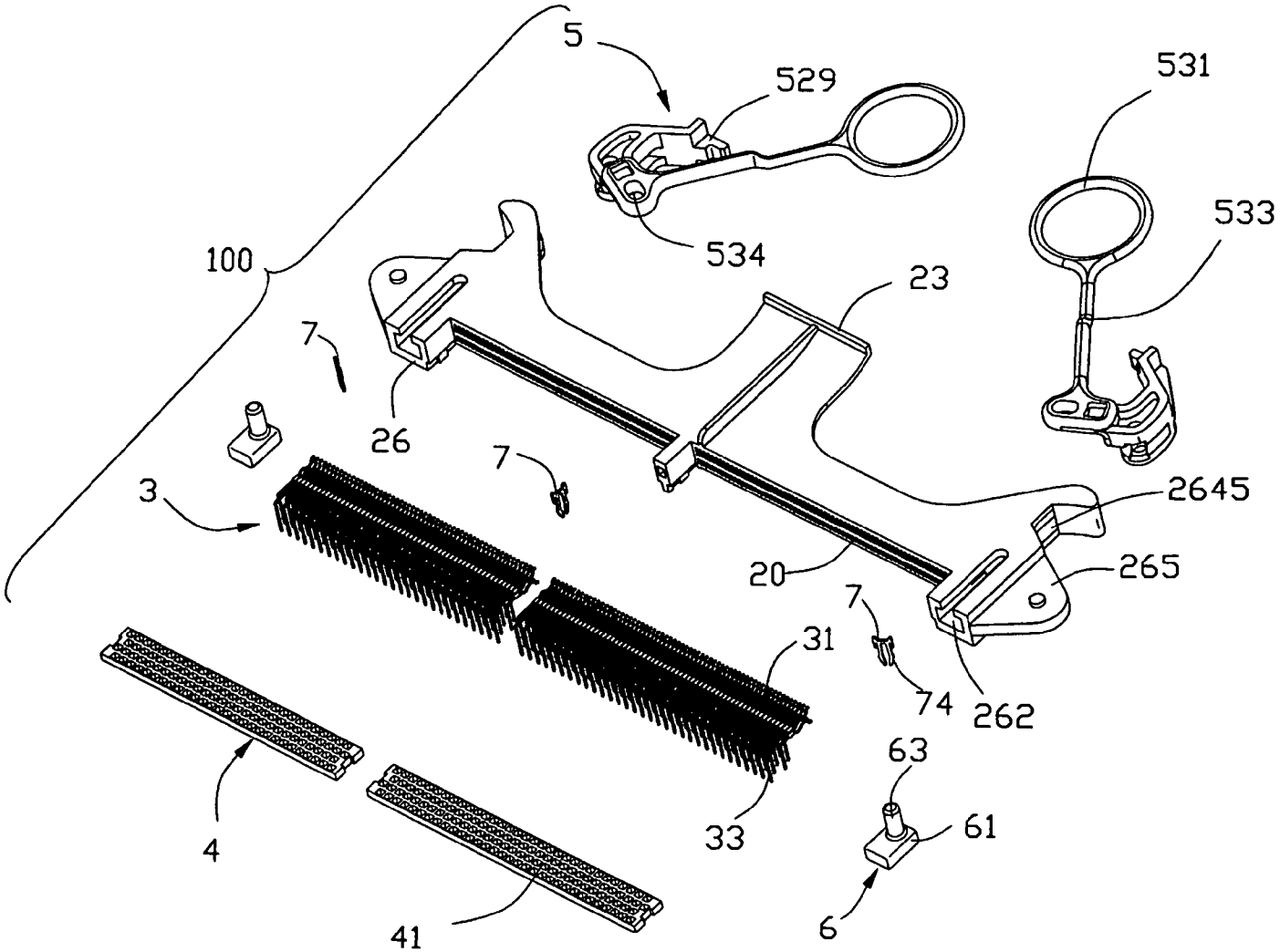
FIG. 4 is a view similar to FIG. 3, while taken from a different aspect.
Figure 5:
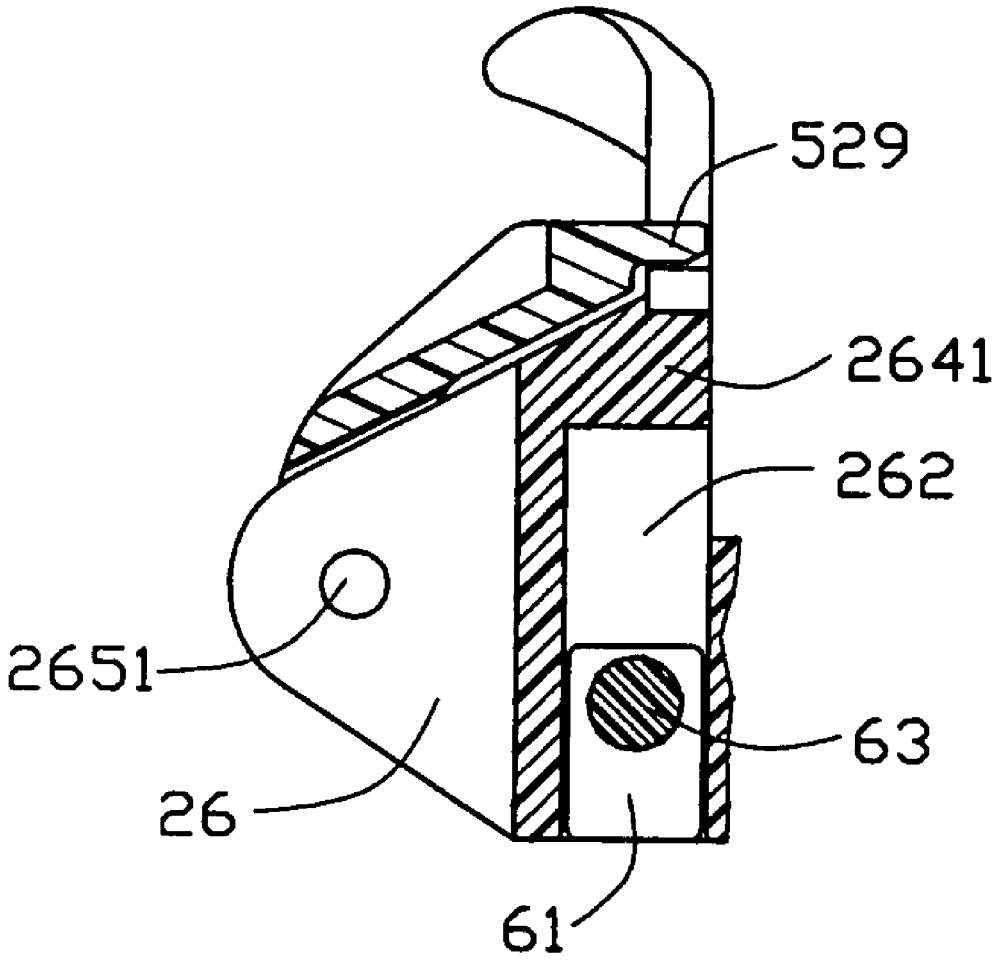
FIG. 5 is a cross-sectional view of the card edge connector taken along line 5-5 of FIG. 1.
Figure 6:
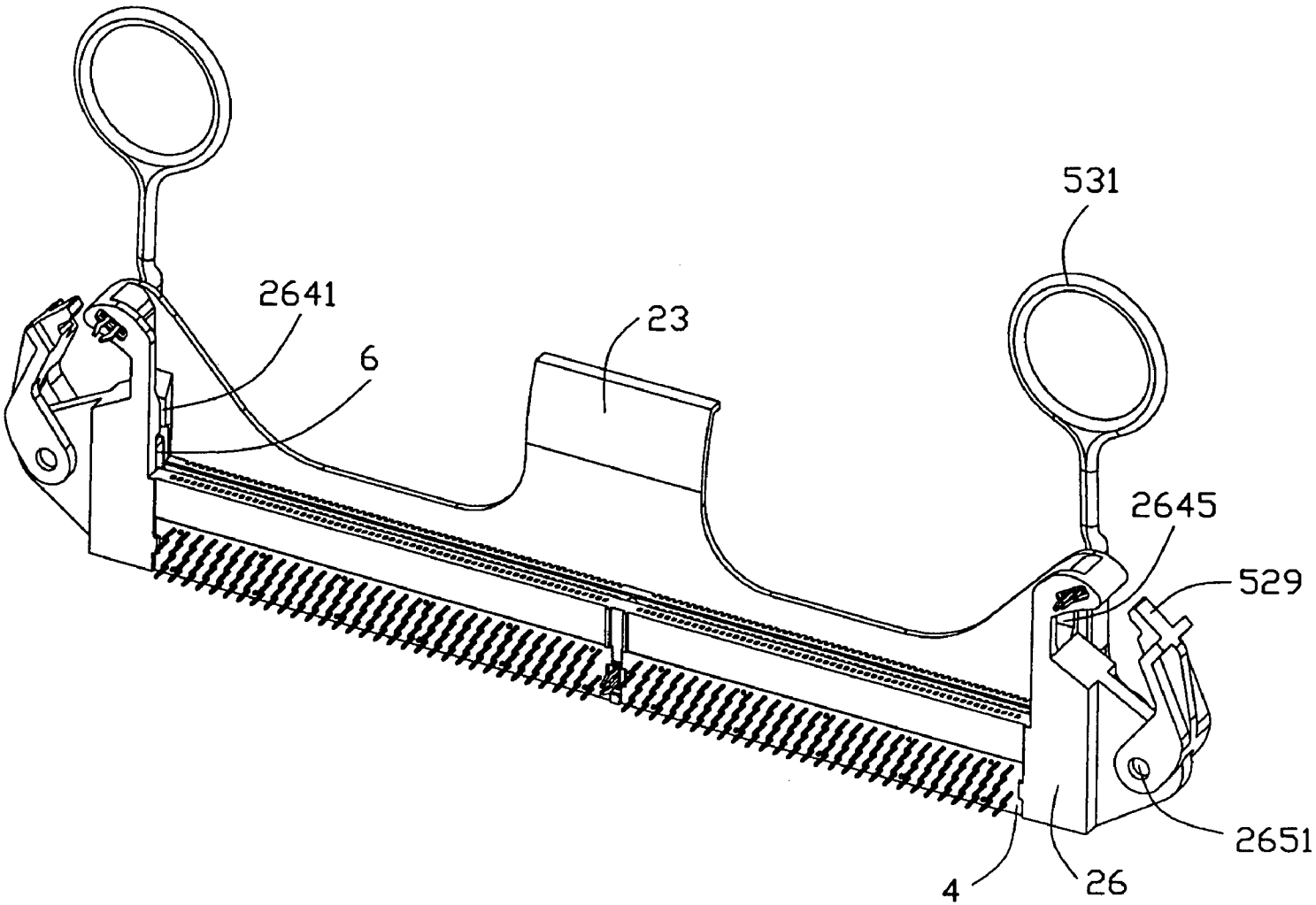
FIG. 6 is an assembled perspective view of the card edge connector in a unlocking position according to the present invention.
Figure 7:
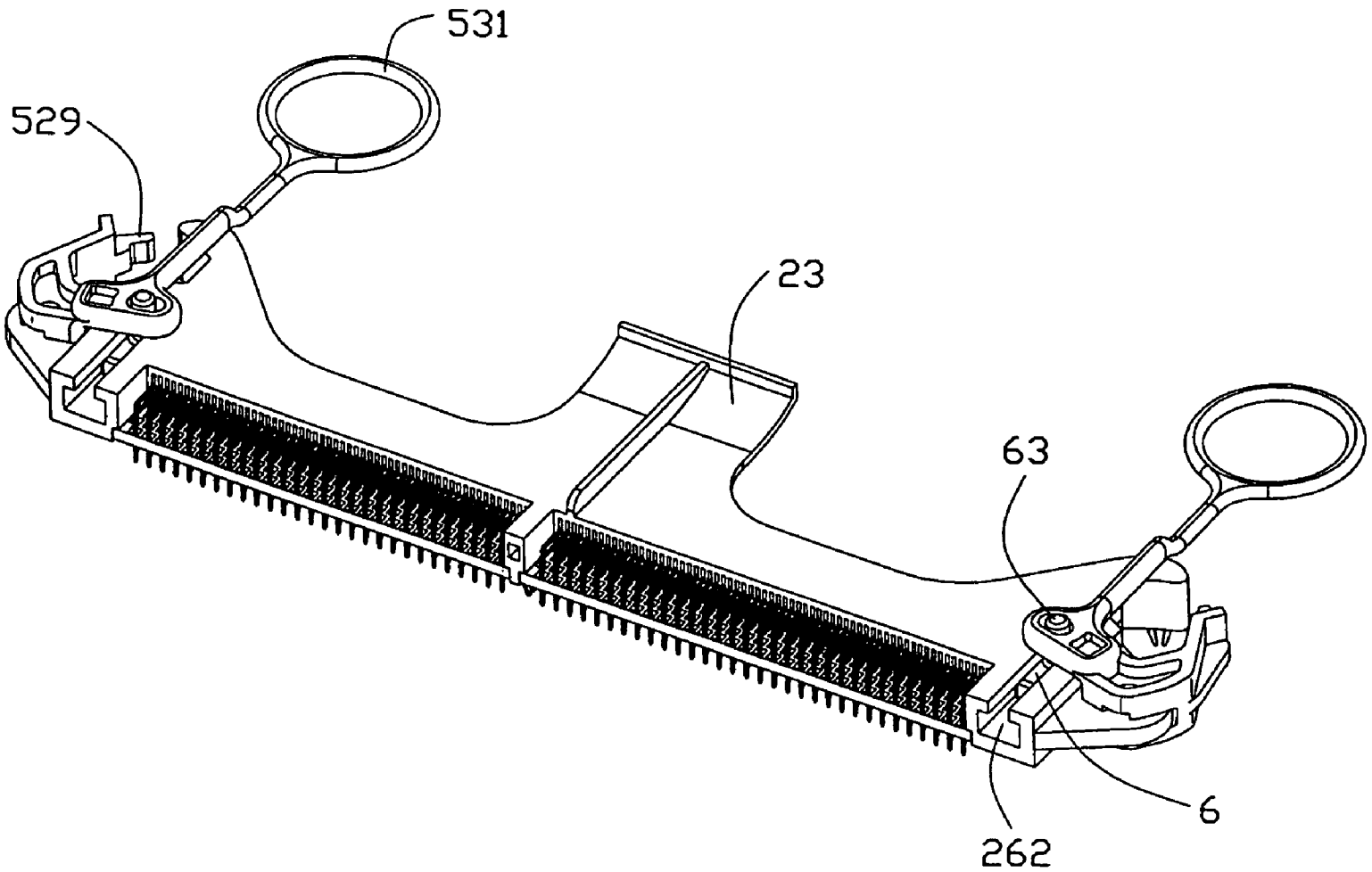
FIG. 7 is a view similar to FIG. 6, while taken from a different aspect.
Figure 8:
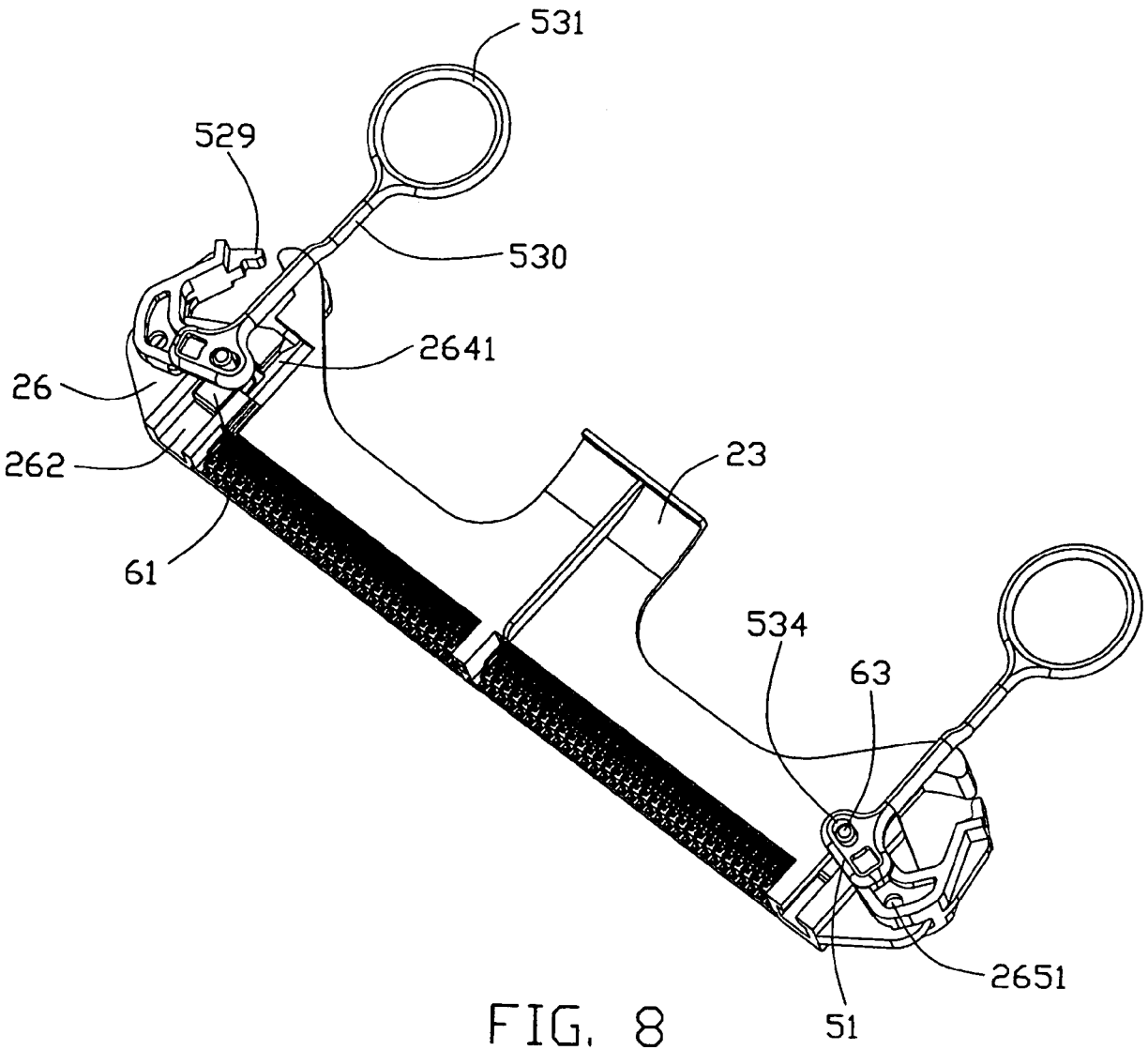
FIG. 8 is a view similar to FIG. 7, with the housing being partially cut away to further illustrate the inside structures thereof.

Referring to FIGS. 1, 3 and 4, the card edge connector 100 according to the present invention, mounted on a mother printed circuit board (PCB), comprises an elongated housing 2 having a pair of longitudinal side walls 28 extending along a lengthwise direction thereof, a pair of end walls 26 extending from opposite ends of the side walls 28, a central elongated slot 21 formed therebetween for receiving a corresponding memory module therein, two rows of contact cavities 29 disposed on opposite sides of the slot 21 for retaining respective right-angled contacts 3 therein. A guiding plate 23 protrudes from a top edge of the side wall 28 for guiding the memory module into the slot 21. A number of board locks 7 are retained in the bottom edge of the end walls 26 for mounting the card edge connector 100 onto the printed circuit board.

The contacts 3 have contacting portions 31 extending into the slot 21 for engaging with conductive pads on opposite sides of the memory module and being arranged in two rows, tail portions 33 projecting out of the housing 2 for connection to circuit traces on the printed circuit board and being arranged in four rows. A pair of spacers 4 are sandwiched between the end walls 26 and each has a plurality of through holes 41 for retaining respective tail portions 33 of the contacts 3 therein, thereby facilitating positioning the tail portions 33 in corresponding holes of the printed circuit board.

The end wall 26 defines a recess 262 which are open through both a side face thereof and a bottom face thereof, and communicating with the slot 21. A movable block 6 includes a rectangular body portion 61 movably mounted in the recess 262 and has a column post 63 protruding outside the side face of the end wall 26.

An ejector 5 pivotably mounted on the end wall 26 includes a base potion 51 having an angled recess 526 for receiving a triangular ear portion 265 extending laterally from the end wall 26, a pair of circular apertures 524 communicating with the angled recess 526 for respectively receiving a pair of shafts 2651 formed on opposite sides of the triangular ear portion 265, and a position hole 534 defined on the other end thereof. The column post 63 of the movable block 6 is disposed in the position hole 534, thereby restricting the movement of the movable block 6 within the recess 262 and preventing the excessively outward rotation of the ejector 5.

The ejector 5 further includes a flexible gripping portion 530 extending upwardly from one end of the base portion 51. The gripping portion 530 has a resilient rod 533 and a circular ring portion 531 formed at a distal end thereof for engagement by an user's finger, a locking portion 529 angled inwardly and upwardly from the other end of the base portion 51 and spaced apart from the gripping portion 530. Wherein the gripping portion 530 is flexible to be deflected toward the slot 21 of the housing 2.

In use, when the printed circuit board and the connector 100 mounted thereon are retained in a computer mainframe defining an opening (not shown) aligned with the slot 21 for reception of the memory module. As the memory module is inserted through the opening and then into the slot 21 of the housing 2, the bottom edge of the module presses the movable block 6 and causes inward movement of the movable block 6 along the recess 262, meanwhile, the ejector 5 connected to the movable block 6 is pivoted inwardly. While the module is completely inserted into the slot 21, the locking portion 529 of the ejector 5 is rotated inwardly through a through hole 2645 of the end wall 26 to a locking position and lock with a side notch of the module, and the locking portion 529 abuts against the triangular ear portion 265. The gripping portion 530 extends out of the opening on the mainframe. Finally, the user moves a small plate movably mounted on the mainframe to close the opening, and the flexible gripping portion 530 is located above the side walls 28 of the housing 2 and deformed by the mainframe to be disposed in the mainframe.

When the module need to be replaced, the user would open the opening on the mainframe, and the gripping portion 530 is able to project outside the opening along the extracting direction of the module and becomes accessible to the user. Then, the user can rotate the circular ring 531 of the gripping section 530 outwardly, the locking portion 529 rotates outwardly to disengage from the side notch of the module, the movable block 6 moves outwardly along the recess 262 and ejects the module out of the slot 21. Finally, the post 63 of the movable block 6 contacts with an inner side face of the recess 262, the body portion 61 of the movable block 6 abuts against bottom edges of inside blocks 2641 formed on opposite inside walls of the recess 262, thereby limiting further outward movement of the movable block 6 and the ejector 5. Meanwhile the top edge of the module is exposed outside the opening, the user can snatch the module and pull it out of the connector 100 completely. In this way, it is convenient for the user to remove the module from the slot 21, without complicated disassembly of the mainframe.

In an alternative embodiment, the movable block 6 and the ejector 5 can be formed integrally to eject the module out of the housing 2, and the gripping portion 530 is also flexible to be deformed toward/away from the side walls 28 of the housing 2 along an insertion/extracting direction of the module.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A card edge connector for receiving a module, comprising:

an insulative housing having a pair of side walls with a module-receiving slot formed therebetween and a plurality of contact-receiving cavities along the slot, and a pair of end walls connected to the side walls;

a plurality of contacts retained in the corresponding contact-receiving cavities and having contacting portions extending into the slot for engaging with the module;

an ejector pivotally mounted on the housing and having a gripping portion which can be deformed toward the side wall along an insertion direction of the module, a position hole and a locking portion for locking with the module; and a block movably mounted on the housing and connected to the ejector to eject the module out of the slot in response to an outward rotation of the ejector, and having a post movably mounted in the position hole and extending outside the end wall.

2. The card edge connector as claimed in claim 1, wherein the gripping portion is located above the side walls and the end walls of the housing.

3. The card edge connector as claimed in claim 1, wherein at least one end wall defines a recess communicating with the slot for receiving the movable block.

4. The card edge connector as claimed in claim 3, wherein the recess is open through both a side face and a bottom face of the end wall.

5. The card edge connector as claimed in claim 1, wherein the end wall has a pair of shafts on opposite sides thereof defining a axis about which the ejector rotates, the ejector has a pair of circular apertures for receiving the corresponding shafts.

6. The card edge connector as claimed in claim 1, wherein the gripping portion has a ring portion at a distal end thereof.

7. The card edge connector as claimed in claim 1, wherein the end wall defines a triangular ear portion extending laterally therefrom, the ejector includes an angular recess for receiving the triangular ear portion.

8. The card edge connector as claimed in claim 1, wherein the end wall has inside block on inner side face thereof for abutting against the movable block.

9. A card edge connector for receiving a module, comprising:

an insulative housing having a pair of side walls a central slot formed therebetween and a plurality of cavities located on opposite sides of the slot, and a pair of end walls connected to the side walls and defining an ear portion extending laterally therefrom;

a plurality of contacts retained in the corresponding cavities and extending into the central slot;

an ejector pivotally mounted on one end of the housing and having an ejecting portion at a bottom end thereof for pressing the module out of the slot, a gripping portion which can be moved toward the side wall along an insertion direction of the module and a locking portion for locking with the module, a recess receiving the ear portion.

10. The card edge connector as claimed in claim 9, wherein the gripping portion is located above the side walls and the end walls of the housing.

11. The card edge connector as claimed in claim 9, wherein the gripping portion has a ring portion at a distal end thereof.

12. The card edge connector as claimed in claim 9, wherein the housing has a guiding plate extending from a top end thereof for facilitating the insertion of the module into the slot and connecting the end walls.

13. The card edge connector as claimed in claim 9, wherein the contact is right-angled.

14. The card edge connector as claimed in claim 9, further including a linearly moveable block actuated by the ejecting portion for directly pressing the module out of the slot.

15. A card edge connector for use with a card, comprising:

an insulative elongated housing defining an elongated slot therein for receiving a card therein;

a plurality of contacts disposed by at least one side of the slot;

an ejection mechanism pivotally mounted to one end of said housing and having thereof a gripping portion where an operator grasps for rotative movement of the ejection mechanism;

and a moveable block discrete from the ejection mechanism and engaged with the ejection mechanism, thus being actuated to move for directly ejecting the card by rotation of the ejection mechanism; wherein engagement between the moveable block and the ejection mechanism does not occurs at a constant point but varies among different regions during rotation of the ejection mechanism.

16. The connector as claimed in claim 15, wherein said moveable block is linearly moved during rotation of the ejection mechanism.

17. The connector as claimed in claim 15, wherein the engagement between the block and the ejection mechanism is implemented by a pin vs. groove structure so as to result in the engagement in said different regions during rotation of the ejection mechanism.

18. The connector as claimed in claim 15, wherein the gripping portion is essentially rotated in an angular range not outwardly exceeding an insertion direction of a card.

19. The connector as claimed in claim 15, wherein the gripping portion is located above the housing in a vertical direction.

20. The connector as claimed in claim 15, wherein said ejection mechanism further includes a locking portion for locking the card inserted into the housing, and said the locking portion is essentially located outside of the corresponding gripping portion in a lengthwise direction of the housing.

* * * * *